United States Patent [19]

Allen, Jr. et al.

[11] Patent Number: 4,868,608

[45] Date of Patent: Sep. 19, 1989

[54] HIGHLIGHT COLOR IMAGING APPARATUS

[75] Inventors: William M. Allen, Jr., Webster; Delmer G. Parker, Rochester; Howard M. Stark, Webster, all of N.Y.

[73] Assignee: Xerox Corporation, Stamford, Conn.

[21] Appl. No.: 140,456

[22] Filed: Jan. 4, 1988

[51] Int. Cl.[4] ..... G03G 21/00

[52] U.S. Cl. ..... 355/303; 355/326; 430/125

[58] Field of Search ..... 355/5, 4, , 15; 430/45

[56] References Cited

U.S. PATENT DOCUMENTS

| | | | |
|---|---|---|---|
| 3,457,900 | 7/1969 | Drexler . | |
| 4,078,929 | 3/1978 | Gundlach | 96/1.2 |
| 4,397,264 | 8/1983 | Hatch | 118/656 |
| 4,430,402 | 2/1984 | Tsushima | 430/45 |
| 4,533,236 | 8/1985 | Garsin | 355/15 |
| 4,771,314 | 9/1988 | Parker et al. | 355/4 |

*Primary Examiner*—A. T. Grimley

*Assistant Examiner*—Barry J. Shapiro

[57] ABSTRACT

Tri-Level Highlight color imaging apparatus and cleaner apparatus therefor. Improved cleaning of a charge retentive surface is accomplished through matching the triboelectric properties of the positive and negative toners and their associated carriers as well as the carrier used in the magnetic brush cleaner apparatus. The carrier in the cleaner upon interaction with the two toners causes them to charge to the same polarity. The carrier used in the cleaner is identical to the one use in the positive developer. The carrier of the negative developer was chosen so that the toner mixed therewith charged negatively in the developer housing.

Thus, the combination of toners and carriers is such that one of the toners charges positively against both carriers and the other of the toners charges negatively against one of the carriers and positively against the other. Due to the application of a positive pretransfer corona both the toners are positive when they reach the cleaner housing and because the carrier employed causes both of the toners to charge positively, toner polarity reversal is precluded.

18 Claims, 4 Drawing Sheets

HIGHLIGHT COLOR IMAGING APPARATUS

BACKGROUND OF THE INVENTION

This invention relates generally to the rendering of latent electrostatic images visible using multiple colors of dry toner of developer and, more particularly, to highlight color imaging and an improved cleaning system for removing residual toner from a charge retentive surface.

The invention can be utilized in the art of xerography or in the printing arts. In the practice of conventional xerography, it is the general procedure to form electrostatic latent images on a xerographic surface by first uniformly charging a photoconductive insulating surface or photoreceptor. The charge is selectively dissipated in accordance with a pattern of activating radiation corresponding to original images. The selective dissipation of the charge leaves a latent charge pattern on the imaging surface corresponding to the areas not struck by radiation.

This charge pattern is made visible by developing it with toner. The toner is generally a colored powder which adheres to the charge pattern by electrostatic attraction.

The developed image is then fixed to the imaging surface of is transferred to a receiving substrate such as plain paper to which it is fixed by suitable fusing techniques.

The concept of tri-level xerography is described in U.S. Pat. No. 4,078,929 issued in the name of Gundlach. The patent to Gundlach teaches the use of tri-level xerography as a means to achieve single-pass highlight color imaging. As disclosed therein, the charge pattern is developed with toner particles of first and second colors. The toner particles of one of the colors are positively charged and the toner particles of the other color are negatively charged. In one embodiment, the toner particles are supplied by a developer which comprises a mixture of triboelectrically relatively positive and relatively negative carrier beads. The carrier beads support, respectively, the relatively negative and relatively positive toner particles. Such a developer is generally supplied to the charge pattern by cascading it across the imaging surface supporting the charge pattern. In another embodiment, the toner particles are presented to the charge pattern by a pair of magnetic brushes. Each brush supplies a toner of one color and one charge. In yet another embodiment, the development system is biased to about the background voltage. Such biasing results in a developed image of improved color sharpness.

In tri-level xerography, the xerographic contrast on the charge retentive surface of photoreceptor is divided three, rather than two, ways as is the case in conventional xerography. The photoreceptor is charged, typically to 900 v. It is exposed imagewise, such that one image corresponding to charged image areas (which are subsequently developed by charged area development, i.e. CAD) stay at the full photoreceptor potential ($V_{ddp}$ or $V_{cad}$, see FIGS. 1*a* and 1*b*). The other image is exposed to discharge the photoreceptor to its residual potential, i.e. $V_c$ or $V_{dad}$ (typically 100 v) which corresponds to discharge area images that are subsequently developed by discharged-area development (DAD). The background areas exposed such as to reduce the photoreceptor potential to halfway between the $V_{cad}$ and $V_{dad}$ potentials, (typically 500 v) and is referred to as $V_w$ or $V_{white}$. The CAD developer is typically biased about 100 v closer to $V_{cad}$ than $V_{white}$ (about 600 v), and the DAD developer system is biased about 100 v closer to $V_{dad}$ than $V_{white}$ (about 400 v).

Various techniques have heretofore been employed to develop electrostatic images as illustrated by the following disclosures which may be relevant to certain aspects of the present invention.

As disclosed in U.S. Pat. No. 3,457,900, magnetic brushes have been designed to give fringe field or solid area development by adjusting the conductivity of the carrier. It is also stated therein that they can also be made to tone areas of less charge and clean areas of greater charge giving what is known in the art as a reverse development.

As discussed in U.S. Pat. No. 4,397,264 which relates to a conventional xerographic image development system, conductive magnetic brush (CMB) development and insulating magnetic brush (IMB) development systems suffer from limitations in their abilities to meet the full range of copy quality requirements. Specifically, insulating magnetic brush development systems have difficulty in using one developer roller to develop both fine lines and solid areas. In order to optimize solid area development with an insulating developer material, the spacing between the developer roller and photoconductive surface must be made quite small. However, low density fine line development occurs at a larger spacing to take advantage of the accuracy of fringe field development with insulating materials. This permits development with high cleaning fields so as to minimize background development.

As further discussed in the '264 patent, conductive magnetic brush development systems inherently fail to faithfully reproduce low density lines. Conductive developer materials are not sensitive to fringe fields. In order to achieve low density fine line development with conductive developer materials, the cleaning field must be relatively low. This produces relatively high background.

U.S. patent application Ser. No. 913,181 now U.S. Pat. No. 4761668 filed in the name of Parker et al and assigned to the same assignee as the instant application which relates to tri-level printing discloses apparatus for minimizing the contamination of one dry toner or developer by another dry toner or developer used for rendering visible latent electrostatic images formed on a charge retentive surface such as a photoconductive imaging member. The apparatus causes the otherwise contaminating dry toner or developer to be attracted to the charge retentive surface in its inter-document and outboard areas. The dry toner or developer so attracted is subsequently removed from the imaging member at the cleaning station.

U.S. patent application Ser. No. 78,750 now U.S. Pat. No. 4761672 filed in the name of Parker et al and assigned to the same assignee as the instant application which relates to tri-level printing discloses apparatus wherein undesirable transient development conditions that occur during start-up and shut-down in a tri-level xerographic system when the developer biases are either actuated or de-actuated are obviated by using a control strategy that relies on the exposure system to generate a spatial voltage ramp on the photoreceptor during machine start-up and shut-down. Furthermore, the development systems' bias supplies are programmed so that their bias voltages follow the photoreceptor voltage ramp at some predetermined offset voltage. This offset is chosen so that the cleaning field between any development roll and the photoreceptor is always within reasonable limits. As an alternative to synchronizing the exposure and developing characteristics, the charging of the photoreceptor can be varied in accordance with the change of developer bias voltage.

U.S. patent application Ser. No. 78,743 now U.S. Pat. No. 4811046 filed in the name of Jerome May and assigned to the same assignee as the instant application which relates to tri-level printing discloses apparatus wherein undesirable transient development conditions that occur during start-up and shut-down in a tri-level xerographic system when the developer biases are either actuated or de-actuated are obviated by the provision of developer apparatuses having rolls which are adapted to be rotated in a predetermined direction for preventing developer contact with the imaging surface during periods of start-up and shut-down. The developer rolls of a selected developer housing or housings can be rotated in the contact-prevention direction to permit use of the tri-level system to be utilized as a single color system or for the purpose of agitating developer in only one of the housings at a time to insure internal triboelectric equilibrium of the developer in that housing.

U.S. patent application Ser. No. 947,321 now U.S. Pat. No. 4771314 filed in the name of Parker et al and assigned to the same assignee as the instant application which relates to tri-level printing discloses printing apparatus for forming toner images in black and at least one highlighting color in a single pass of a charge retentive imaging surface through the processing areas, including a development station, of the printing apparatus. The development station includes a pair of developer housings each of which has supported therein a pair of magnetic brush development rolls which are electrically biased to provide electrostatic development and cleaning fields between the charge retentive surface and the developer rolls. The rolls are biased such that the development fields between the first rolls in each housing and the charge retentive surface are greater than those between the charge retentive surface and the second rolls and such that the cleaning fields between the second rolls in each housing and the charge retentive surface are greater than those between the charge retentive surface and the first rolls.

U.S. patent application Ser. No. 95,486 now U.S. Pat. No. 4833504 filed in the name of Delmer Parker and assigned to the same assignee as the instant application which relates to tri-level printing discloses a magnetic brush developer apparatus comprising a plurality of developer housings each including a plurality of magnetic rolls associated therewith. The magnetic rolls disposed in a second developer housing are constructed such that the radial component of the magnetic force field produces a magnetically free development zone intermediate a charge retentive surface and the magnetic rolls. The developer is moved through the zone magnetically unconstrained and, therefore, subjects the image developed by the first developer housing to minimal disturbance. Also, the developer is transported from one magnetic roll to the next. This apparatus provides an efficient means for developing the complementary half of a tri-level latent image while at the same time allowing the already developed first half to pass through the second housing with minimum image disturbance.

U.S. patent application Ser. No. 31,627 filed in the name of Parker et al and assigned to the same assignee as the instant application which relates to tri-level printing discloses an electronic printer employing tri-level xerography to superimpose two images with perfect registration during the single pass of a charge retentive member past the processing stations of the printer. One part of the composite image is formed using Magnetic Ink Character Recognition (MICR) toner, while the other part of the image is printed with less expensive black, or color toner. For example, the magnetically readable information on a check is printed with MICR toner and the rest of the check in color or in black toner that is not magnetically readable.

The problem of fringe field development in a tri-level highlight color, single pass imaging system is addressed in U.S. patent application (D/86201, now Ser. No. 07/132074 Attorney's Docket No.) mailed to the U.S. Patent Office on or about Dec. 9, 1987 which application is assigned to the same assignee as the instant invention.

In this application there is disclosed a magnetic brush developer apparatus comprising a plurality of developer housings each including a plurality of magnetic brush rolls associated therewith. Conductive magnetic brush (CMB) developer is provided in each of the developer housings. The CMB developer is used to develop electronically formed images. The developer conductively, as measured in a Gutman conductivity cell, is in the range of 10–9 to 10–13 (ohm-cm)-1. The toner concentration of the developer is in the order of 2.0 to 3.0% by weight and the charge level is less than 20 microcoulombs/gram and the developer rolls are spaced from the charge retentive surface a distance in the order of 0.40 to 0.120 inch.

U.S. patent application (D/87227, now Ser. No. 07/131498 Attorney's Docket No.) mailed to the U.S. Patent Office on or about Dec. 8, 1987 which application is assigned to the same assignee as the instant invention discloses a highlight color imaging method and apparatus including structure for forming a single polarity charge pattern having at least three different voltage levels on a charge retentive surface wherein two of the voltage levels correspond to two image areas and the third voltage level corresponds to a background area. Interaction between developer materials contained in a developer housing and an already developed image in one of the two image areas is minimized by the use of a scorotron to neutralize the charge on the already developed image.

U.S. Pat. No. 4,430,402 granted to Shuichi Tsushima on Feb. 7, 1984 discloses to two-component type dry developer for use in dichromatic electrophotography comprising two kinds of developers, wherein the developers comprises a toner and a carrier and are adapted to develop both positively and negatively electrified electrostatic images successively with toners different in polarity and color from each other and further wherein one carrier has a triboelectrification property of being electrified positively by friction with either of the two toners while the other carrier has a triboelectrification property of being electrified negatively by friction with either of the two toners.

The process of creating tri-level, highlight color images on a charge retentive sureface results in a charge retentive surface containing both positive and negative images which must be conditioned prior to transfer to a copy substrate. To this end, a positive pre-transfer corona discharge device is provided which changes the polarity of the negative image to positive and increases somewhat the polarity of the positive image. After transfer the residual toner remaining on the charge retentive surface is removed at a cleaning station. At the cleaning station, a cleaning member such as a magnetic brush is electrically biased to a negative polarity to enhance removal of positive residual toner. The brush portion of the magnetic brush is formed by means of carrier beads which extend in a radial direction form a base member. Heretofore, in an two-color imaging system of the type contemplated, some of the toner removed by the cleaning system was redeposited upon the charge retentive surface. This is an undesirable phenomenon. We discovered the cause of this redeposition to be attributable to the negative toner, which had been changed to a positive polarity by the pre-transfer step, having its polarity reversed in the cleaning apparatus. This is because of the triboelectric relationship between the carrier in the cleaner housing and this toner caused the toner to charge negatively through its interaction with the particular carrier employed.

BRIEF SUMMARY OF THE INVENTION

We solved the problem of toner charge reversal by providing a carrier in the cleaner system which upon interaction with the two toners caused the toners to charge positively. The toner used in the cleaner is identical to that used in the positive developer. The carrier of the negative developer was chosen so that the toner mixed therewith charged negatively in its developer housing.

Thus, the combination of toners and carriers is such that one of the toners charges positively against both carriers and the other of the toners charges negatively against one of the carriers and positively against the other. Due to the application of a positive pretransfer corona both the toners are positive when they reach the cleaner housing and because the carrier employed causes both of the toners to charge positively, toner polarity reversal is precluded.

DETAILED DESCRIPTION OF THE PREFERRED EMBODIMENT OF THE INVENTION

Figure 1A:
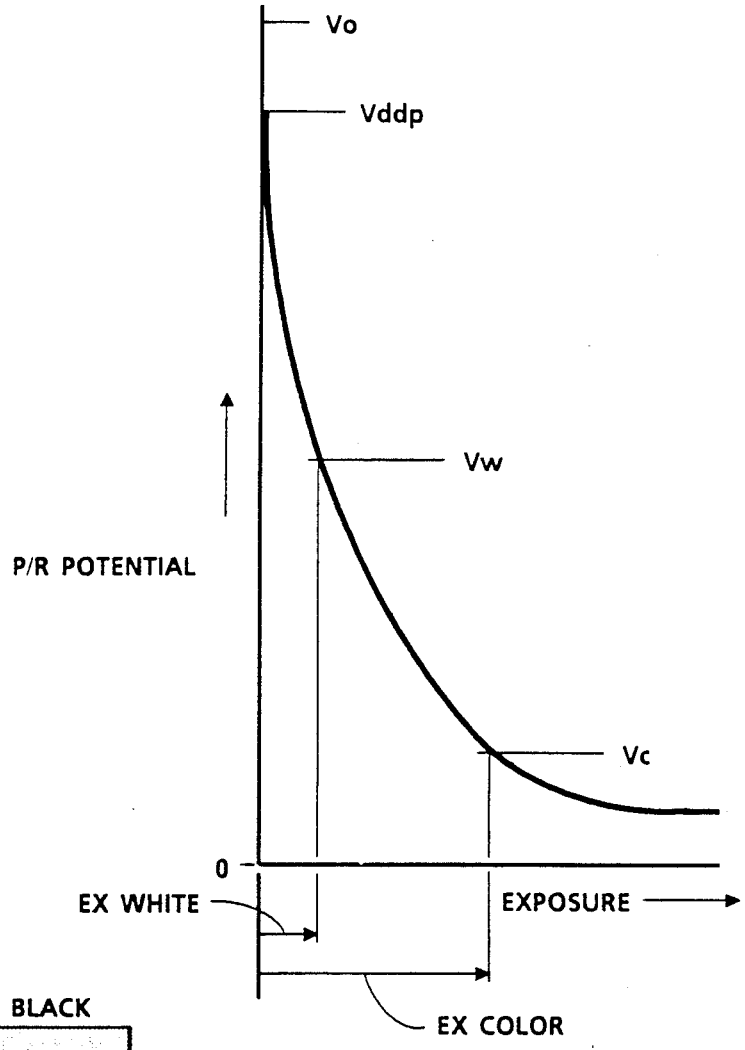
FIG. 1*a* is a plot of photoreceptor potential versus exposure illustrating a tri-level electrostatic latent image.
Figure 1B:
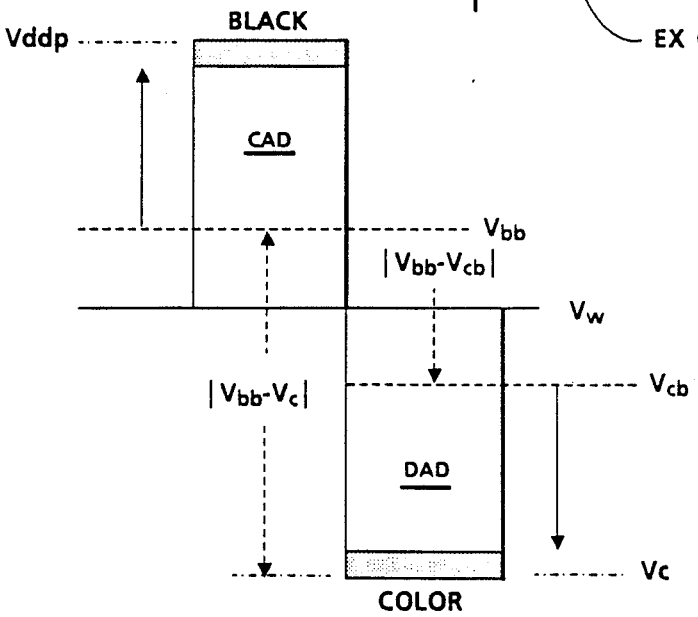
FIG. 1*b* is a plot of photoreceptor potential illustrating singlepass, highlights color latent image characteristics.

For a better understanding of the concept of tri-level imaging, a description thereof will now be made with reference to FIGS. 1*a* and 1*b*.FIG. 1*a* illustrates the tri-level electrostatic latent image in more detail. Here $V_o$ is the initial charge level, $V_{ddp}$ the dark discharge potential (unexposed), $V_w$ the white discharge level and $V_c$ the photoreceptor residual potential (full exposure).

Color discrimination in the development of the electrostatic latent image is achieved by passing the photoreceptor through two developer housings in tandem which housings are electrically biased to voltages which are offset from the background voltage $V_w$, the direction of offset depending on the polarity or sign of toner in the housing. One, housing (for the sake of illustration, the second) contains developer with black toner having triboelectric properties such that the toner is driven to the most highly charged ($V_{ddp}$) areas of the latent image by the electric field between the photoreceptor and the development rolls biased at $V_{bb}$ (V black bias) as shown in FIG. 1*b*. Conversely, the triboelectric charge on the colored toner in the first housing is chosen so that the toner is urged towards parts of the latent image at residual potential, $V_c$ by the electric field existing between the photoreceptor and the development rolls in the first housing at bias voltage $V_{cb}$ (V color bias).

Figure 2:
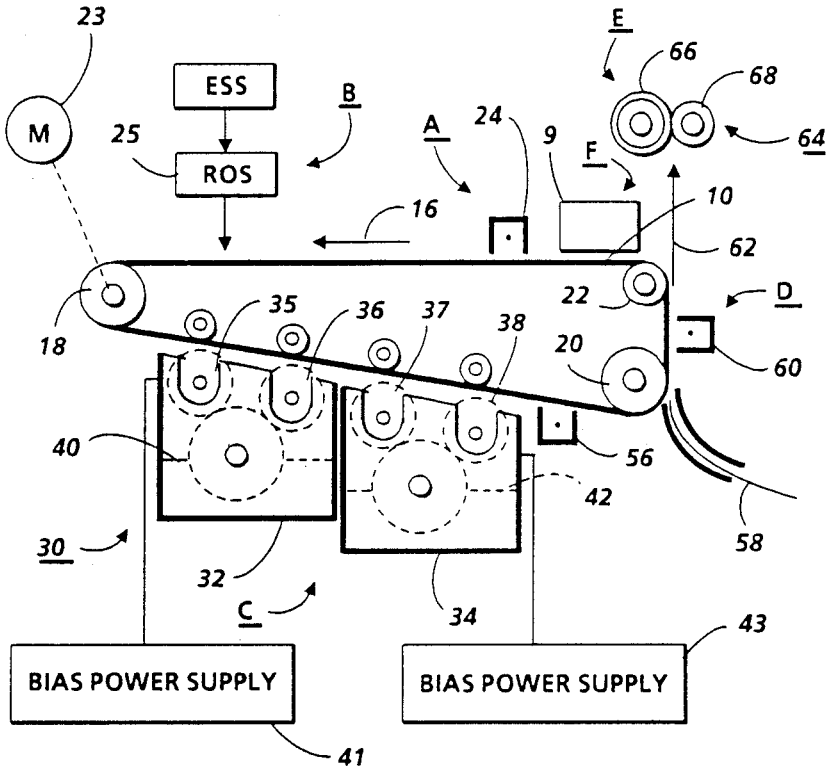
FIG. 2 is schematic illustration of a printing apparatus incorporating the inventive features of our invention.

As shown in FIG. 2, a printing machine incorporating our invention may utilize a charge retentive member in the form of a photoconductive belt 10 consisting of a photoconductive surface and an electrically conductive substrate and mounted for movement past a charging station A, an exposure station B, developer station C, transfer station D and cleaning station F. Belt 10 moves in the direction of arrow 16 to advance successive portions thereof sequentially through the various processing stations disposed about the path of movement thereof. Belt 10 is entrained about a plurality of rollers 18, 20 and 22, the former of which can be used as a drive roller and the latter of which can be used to provide suitable tensioning of the photoreceptor belt 10. Motor 23 rotates roller 18 to advance belt 10 in the direction of arrow 16. Roller 18 is coupled to motor 23 by suitable means such as a belt drive.

As can be seen by further reference to FIG. 2, initially successive portions of belt 10 pass through charging station A. At charging station A, a corona discharge device such as a scorotron, corotron or dicorotron indicated generally by the reference numeral 24, charges the belt 10 to a selectively high uniform positive or negative potential, $V_o$. Preferably charging is negative. Any suitable control, well known in the art, may be employed for controlling the corona discharge device 24.

Next, the charged portions of the photoreceptor surface are advanced through exposure station B. At exposure station B, the uniformly charged photoreceptor or charge retentive surface 10 is exposed to a laser based input and/or output scanning device 25 which causes the charge retentive surface to be discharged in accordance with the output from the scanning device. Preferably the scanning device is a three level laser Raster Output Scanner (ROS). Alternatively, the ROS could be replaced by a conventional xerographic exposure device.

The photoreceptor, which is initially charged to a voltage $V_o$, undergoes dark decay to a level $V_{ddp}$. When exposed at the exposure station B it is discharged to $V_w$ imagewise in the background (white) image areas and to $V_c$ which is near zero or ground potential in the highlight (i.e. color other than black) color parts of the image. See FIG. 1*a*.

At development station C, a magnetic brush development system, indicated generally by the reference numeral 30 advances developer materials into contact with the electrostatic latent images. The development system 30 comprises first and second developer housings 32 and 34. Preferably, each magnetic brush development housing includes a pair of magnetic brush developer rollers. Thus, the housing 32 contains a pair of rollers 35, 36 while the housing 34 contains a pair of magnetic brush rollers 37,38. Each pair of rollers advances its respective developer material into contact with the latent image. Appropriate developer biasing is accomplished via power supplies 41 and 43 electrically connected to respective developer housing 32 and 34.

Color discrimination in the development of the electrostatic latent image is achieved by passing the photoreceptor past the two developer housing 32 and 34 in a single pass with the magnetic brush rolls 35, 36, 37 and 38 electrically biased to voltages which are offset from the background voltage $V_w$, the direction of offset depending on the polarity of toner in the housing. One housing e.g. 32 (for the sake of illustration, the first) contains red developer 40 having triboelectric properties such that the red toner is driven to the discharged development areas of the latent image by the electrostatic field (development field) between the photoreceptor and the development rolls biased at Vcb as shown in FIG. 1*b*. Conversely, the triboelectric charge on black developer 42 in the second housing is chosen so that the black toner is urged towards charged development areas by the electrostatic field (development field) existing between the photoreceptor and the development rolls in the second housing at bias voltages Vbb.

In an operative embodiment of the invention, good quality magnetic brush cleaning (i.e. without redeposition of toner onto the charge retentive surface) is promoted by using developers 40 and 42 and cleaner carrier which have matched triboelectric properties for this purpose. The triboelectric properties of the toners and carriers utilized in the developer housing 32 and 34 and cleaner apparatus 9 are matched such that both the positive and negative toners used charge positively against the carrier in the cleaner system. While both of the toners of the developers charge positively against the cleaner carrier one of them charges negatively against its carrier and the other charges positively against its carrier. The carrier used for the cleaner carrier is also employed in the positive developer.

Figure 4:
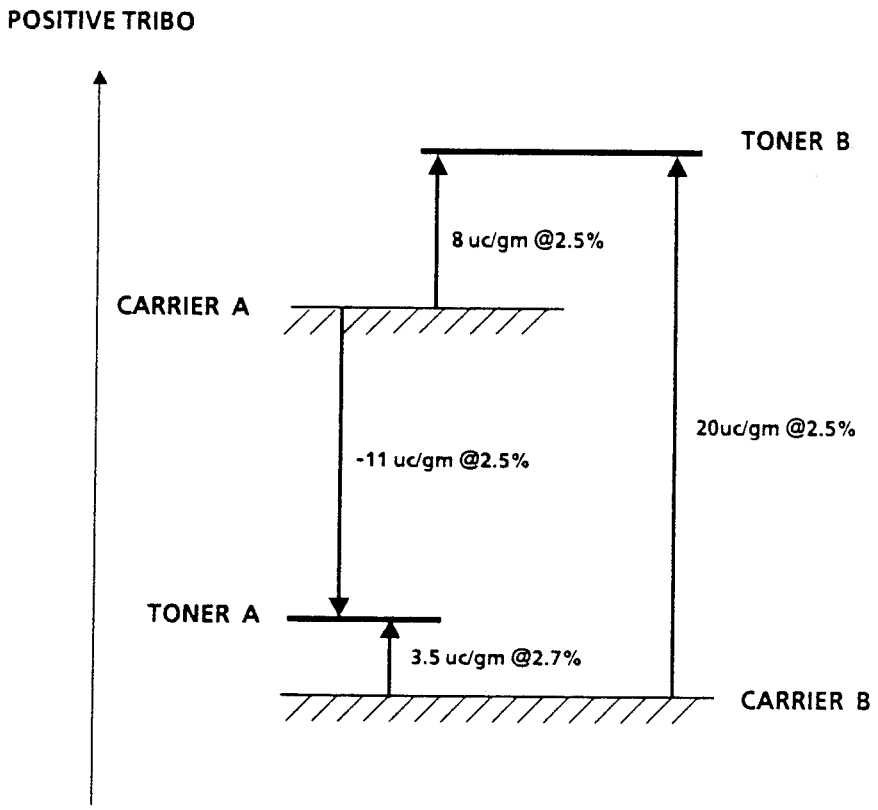
FIG. 4 discloses tribo relationships of various combinations of toners and carriers utilized in carrying out the present invention.

The matched properties of the toners and carriers utilized will now be described in connection with FIG. 4. To illustrate how the tribo matching concept can be used to effect good magnetic brush cleaning, the developer housing 32 contains a red, DAD developer "A" and the developer housing 34, a black CAD developer "B". The developer "A" comprises toner "A" and carrier "A" while the developer "B" comprises toner "B" and carrier "B".

Carrier "A" consists of 100 to 150 micron Hoeganese steel core coated (by weight) with 1.2% a methyl terpolymer with 20%, by weight of carbon black dispersed therein. Toner "A" is made up (by weight) of 85% PLIOLITE (Trademark of Goodyear Tire and Rubber Company), 13.4% of a masterbatch of 1:1 litho scarlet pigment/negative charging styrene n-butyl methacralate polymer, 0.56% magneta and hostaperm pink pigments predispersed in polymer, 1% di-methhyl di-stearyl ammonium methyl sulfate, 0.5% aerosil, and 0.1% zinc stearate. When this developer is mixed to a 2.5% (by weight) toner concentration and rolled milled for 10 minutes, the toner's tribo, as measure by placing the developer in a screened faraday cage and removing the toner with an air stream, is a negative 11 microcoulombs/gram.

The black carrier in developer "B" consists of 100 to 150 micron Hoeganese steel core coated (by weight) with 0.4% of a positive charging co-polymer (cholortrifloro-ethylene + polyvinyl chloride) with 20%, by weight of VULCAN (Trademark of Cabot Corporation) carbon black dispersed therein. The composition of the black toner is 92% styrene n-butyl methacralate polymer, 6% carbon B REGAL 330 (Trademark of Cabot Corporation) carbon black, and 2% cetyl pyridinium chloride. The tribo of the black toner as determined by the roll mill and faraday cage method is a positive 20 micro-coulombs/gram.

When toner "A" is mixed at a concentration of 2.7% (by wt) with carrier "B" and roll milled for ten minutes, it's measured tribo is a positive 3.5 micro-coulombs/gm.

Roll milling Toner "B" at a 2.5% toner concentration with carrier A produces a toner of positive 8 microcoulombs/gm. However toner "B" is in the second developer housing does not come into contact to interact with carrier "A".

In our experiment carrier "B" was used in the magnetic brush cleaner. Utilizing a positive pre-transfer corona charging step, both toners are converted to a common polarity to facilitate electrostatic transfer. As a result, toner A (original charge ~ -11 microcoulombs/gm) arrives at the magnetic brush cleaner with a net positive charge of ~ 10 micro-coulombs/ gm and toner B (original charge ~ 20 micro-coulombs/gm) with a positive charge of ~ 25 micro-coulombs/gm. A negative voltage bias on the magnetic brush cleaner removes the positively charged particles and from the photoreceptor. After they enter a cleaning housing, the toner particles are collected by a de-toning roll that is biased negatively with respect to the magnetic cleaning brush. However, this may take more than one revolution of the magnetic brush if the toner becomes intermingled with the carrier. Because toners A & B both charge positively against carrier "B", there is no tendency for toner "A" to revert to its original negative charge state. Therefore, toner "A" will not be re-deposited on the photoreceptor as the magnetic brush rotates, but will remain in the cleaning brush until it is picked off by the de-toning roll.

The small positive tribo (+3.5 uc/gm) generated by toner "A" when it passes through the second developer housing is not sufficient to reverse the polarity of toner "A" (−11 uc/gm) in the developed image and as a result contamination of the second developer by toner A is neglible.

Throughout a 100,000 copy test on a tri-level machine, using the above materials, the magnetic brush cleaner cleaned the photoreceptor acceptably.

In tri-level xerography, the entire photoreceptor voltage difference ($|V_{ddp}-V_c|$, as shown in FIG. 1*a*) is shared equally between the charge area development (CAD) and the discharged area development (DAD). This corresponds to approximately 800 volts (if a realistic photoreceptor value for $V_{ddp}$ of 900 volts and a residual discharge voltage of 100 volts are assumed). Allowing an additional 100 volts for the cleaning fields ($|V_{bb}-V_{white}|$ and $|V_{white-Vcb}|$) in each development housing means as actual development contrast voltage for CAD of approximately 300 volts and an approximately equal amount for DAD. In the foregoing case the 300 volts of contrast voltage is provided by electrically biasing the first developer housing to a voltage level of approximately 600 volts and the second developer housing to a voltage level of 400 volts.

A sheet of support material 58 is moved into contact with the toner image at transfer station D. The sheet of support material is advanced to transfer station D by conventional sheet feeding apparatus, not shown. Preferably, the sheet feeding apparatus includes a feed roll contacting the uppermost sheet of a stack copy sheets. Feed rolls rotate so as to advance the uppermost sheet from stack into a chute which directs the advancing sheet of support material into contact with photoconductive surface of belt 10 in a timed sequence so that the toner powder image developed thereon contacts the advancing sheet of support material at transfer station D.

Because the composite image developed on the photoreceptor consists of both positive and negative toner, a positive pre-transfer corona discharge member 56 is provided to condition the toner for effective transfer to a substrate using negative corona discharge.

Transfer station D includes a corona generating device 60 which sprays ions of a suitable polarity onto the backside of sheet 58. This attracts the charged toner powder images from the belt 10 to sheet 58. After transfer, the sheet continues to move, in the direction of arrow 62, onto a conveyor (not shown) which advances the sheet to fusing station E.

Fusing station E includes a fuser assembly, indicated generally by the reference numeral 64, which permanently affixes the transferred powder image to sheet 58. Preferably, fuser assembly 64 comprises a heated fuser roller 66 and a backup roller 68. Sheet 58 passes between fuser roller 66 and backup roller 68 with the toner powder image contacting fuser roller 66. In this manner, the toner powder image is permanently affixed to sheet 58. After fusing, a chute, not shown, guides the advancing sheet 58 to a catch tray, also not shown, for subsequent removal from the printing machine by the operator.

After the sheet of support material is separated from photoconductive surface of belt 10, the residual toner particles carried by the non-image areas on the photoconductive surface are removed therefrom. These particles are removed at cleaning station F. The magnetic brush cleaner housing 9 is disposed at the cleaner station F. The cleaner apparatus comprises a conventional magnetic brush roll structure for causing carrier particles in the cleaner housing to form a brush-like orientation relative to the roll structure and the charge retentive surface. It also includes a pair of detoning rolls for removing the residual toner from the brush.

Subsequent to cleaning, a discharge lamp (not shown) floods the photoconductive surface with light to dissipate any residual electrostatic charge remaining prior to the charge thereof for the successive imaging cycle.

The magnetic brush rolls 35 and 36 may comprise any conventional structure known in the art that provides a magnetic field that forms the developer material in the housing 32 into a brush-like configuration in the development zone between the rolls 35 and 36 and the charge retentive surface. This arrangement effects development of one of the two tri-level images contained on the charge retentive surface in a well known manner.

The magnetic brush rolls 37 and 38 on the other hand are constructed such that development of the other of the two tri-level image is accomplished with minimal disturbance of the first image. To this end, the magnetic rolls 37 and 38 comprise magnetic force fields as depicted in FIG. 3*a* and 3*b*, respectively. As shown therein, the radial force profiles of the these two rolls are such as to cause developer to be picked up from the developer housing 34 and conveyed to the top of the roll 37 where the developer becomes magnetically unconstrained. The developer is moved through the development zone in a magnetically unconstrained manner until it is attracted to the roll 38 due to the radial magnetic forces of that roll. Magnetic poles are designated N (north) or S (south).

As illustrated in the drawings, the magnetic fields are plotted around the central axis of a two-roll magnetic brush development system such as the one comprising rolls 37,38. For a multiple roll development system comprising more than two rolls, roll 38 is replicated. The rolls are driven synchronously in this example, although it is also possible to have independent drive mechanisms for each roller.

Figure 3:
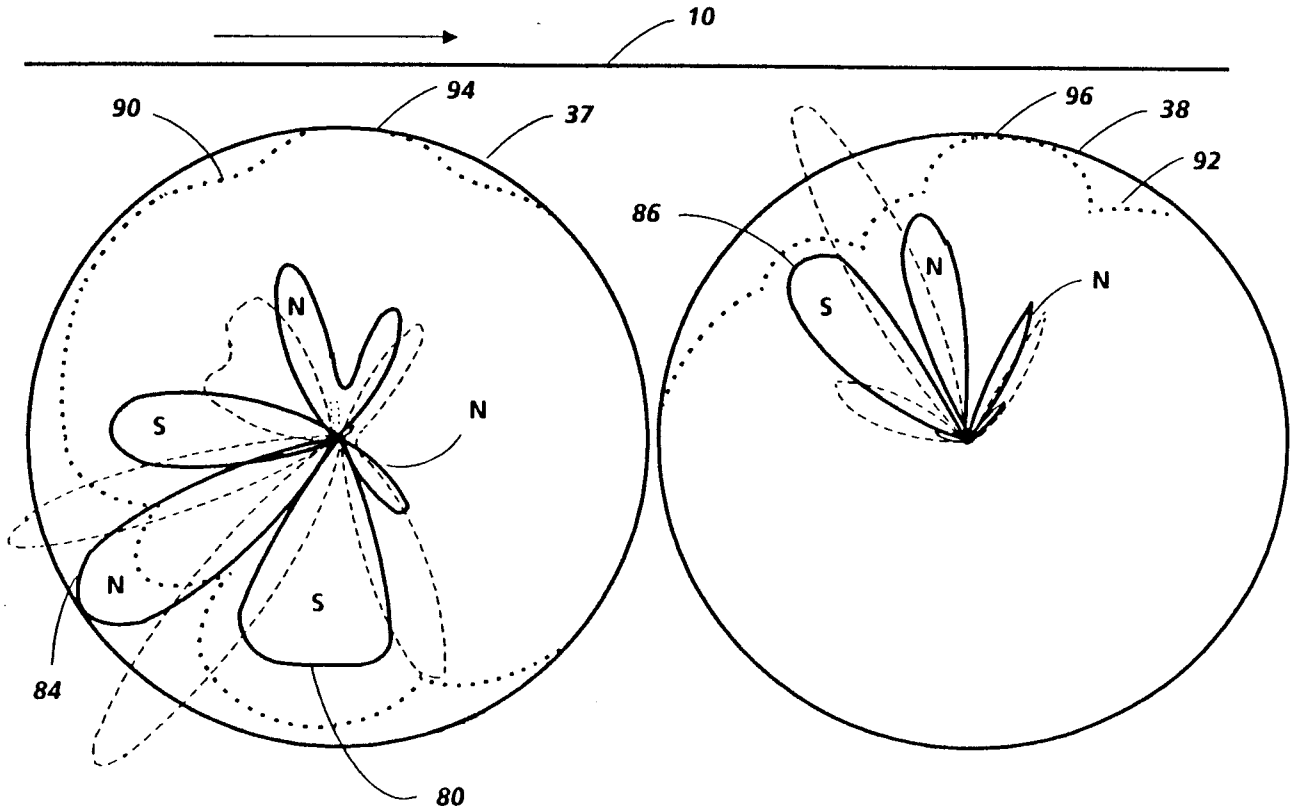
FIG. 3 is a plot of the magnetic fields around the central axis of a two-roll magnetic brush development system incorporated in the printing apparatus of FIG. 2.

FIG. 3 depicts the radial components, respectively, of rolls 37 and 38. As illustrated in the drawing, the magnetic fields are plotted around the central axis of a two-roll magnetic brush development system such as the one comprising rolls 37,38.

The development system additionally consists of a sump, or reservoir, of magnetic developer material, and optionally a mixing system, paddle wheel, or other apparatus to maintain the developing properties of the material in the sump. The developer rolls are rotating non-magnetic cylinders or shells having roughened or longitudinally corrugated surfaces to urge the developer along by frictional forces around fixed internal magnets. The shells are driven synchronously in this example; it is also possible to have independent drive mechanisms for each roller.

During the development process of the system, the direction of rotation of the shell around either fixed magnet is clockwise. However, the system can also be configured to develop in the counterclockwise direction with no compromise in performance, depending on the desired properties of the development system with respect to the direction of the photoreceptor (i.e., against-mode or with-mode development).

In the case described, the photoreceptor is located above the development rolls. The developer materials are transported from left to right from the sump to roll 37, to Roll 38, back to the sump.

A broad radial pole 80 of roll 37 (FIG. 3) positioned at 6 o'clock serves to lift magnetic developer material from a donor roll in the sump or housing 32. The combination of tangential and radial fields starting with pole 84 transport the developer material along the surface of the developer roll until about the 11 o'clock position of roll 37. At that point, the developer becomes magnetically unconstrained due to the lack of poles or strong poles in this area to constrain the developer in a brush-like configuration.

The developer is moved magnetically unconstrained through the part of the developement zone delineated by the roll 37 and the charge retentive surface until the developer comes under the influence of a strong radial south pole 86 of the magnetic 38. Movement through the aforementioned zone is effected through the cooperation of the charge retentive surface and the developer shell. The pole 86 serves to effect transition of the developer from the roll 37 to the roll 38 without magnetically constraining the developer so as to cause scavenging of the first image as it passes the second developer housing. As will be observed, the poles following the pole 86 in the clockwise direction are progressively weaker so that the developer is magnetically unconstrained as it moves through the part of the development zone delineated by the roll 38 and the charge retentive surface.

What is claimed is:

1. Printing apparatus comprising:

means for forming visible images on a charge retentive surface;

said means for forming visible images comprising at least first and second developer structures;

means for moving said charge retentive surface past said first and second developer structure in that order;

first developer material contained in said first developer structure, said first developer material comprising first toner and first carrier particles;

second developer material contained in said second developer structure, said second developer material comprising second toner and second carrier particles;

means for removing residual toner from said charge retentive surface, said residual toner removing means comprising a brush;

said first and second carriers having triboelectric properties relative to said first and second toners such that said first and second toner charge to opposite polarities against their respective carriers and such that the degree of charging of said first toner against said second carrier is insufficient to change its polarity thereby precluding contamination of said second developer material with said first toner; and said brush having bristles with triboelectric properties such that both said first and second toners charge to the same polarity when interacting therewith.

2. Apparatus according to claim 1 including corona discharge means for changing the polarity of one said toners prior to the residual toner being removed by said residual toner removing means.

3. Apparatus according to claim 2 wherein said corona discharge means comprises a positive corotron.

4. Apparatus according to claim 2 wherein said first and second toners charge to a positive polarity when interacting with the carrier forming the bristles of said brush.

5. Apparatus according to claim 4 wherein said corona discharge means comprises a positive corotron.

6. Apparatus according to claim 3 wherein said first and second toners are different colors.

7. Apparatus according to claim 5 wherein said first and second toners are different colors.

8. A method of printing powder images including the steps of:

forming a tri-level image on a charge retentive surface;

developing a portion of said tri-level image with a first toner and carrier particle mixture having triboelectric properties such that the toner of the first mixture charges to a first polarity when the developer is agitated;

developing a second portion of said tri-level image with a second toner and carrier particle mixture having triboelectric properties such that the second mixture charges to a second polarity which is opposite to said first polarity;

said toner of said first toner and carrier mixture having triboelectric properties relative to the carrier of said second mixture such that the degree of charging thereof against said carrier of said second mixture is insufficient to change its polarity thereby minimizing contamination of said second mixture with toner from said first mixture.

transferring said tri-level image to a copy substrate; and removing residual toner from said charge retentive surface with a structure comprising a carrier against which said first and second toners charge to the same polarity.

9. The method according to claim 8 including the step of changing the polarity of one said toners prior to the residual toner being removed by said residual toner removing means.

10. The method according to claim 9 wherein the step of changing the polarity of one of said toners prior to the residual toner being removed by said residual toner removing means changes and first and second toners to a positive polarity.

11. The apparatus according to claim 1 wherein said brush is a magnetic brush and said bristles comprise carrier particles.

12. Apparatus according to claim 11 including corona discharge means for changing the polarity of one said toners prior to the residual toner being removed by said residual toner removing means.

13. Apparatus according to claim 12 wherein said corona discharge means comprises a positive corotron.

14. Apparatus according to claim 12 wherein said first and second toners charge to a positive polarity when interacting with the carrier forming the bristles of said brush.

15. Apparatus according to claim 14 wherein said corona discharge means comprises a positive corotron.

16. Apparatus according to claim 13 wherein said first and second toners are different colors.

17. Apparatus according to claim 15 wherein said first and second toners are different colors.

18. Printing apparatus comprising:

means for forming visible images on a charge retentive surface;

said means for forming visible images comprising at least first and second developer structures;

first developer material contained said first developer structure, said first developer material comprising first toner and first carrier particles;

second developer material contained in said second developer structure, said second developer material comprising second toner and second carrier particles;

said first and second carriers having triboelectric properties relative to said first and second toners such that said first and second toners charge to opposite polarities against their respective carriers and such that both of said toners charge positively against said second carrier and said toners charge oppositely against said first carrier; and means for removing residual toner from said charge retentive surface, said residual toner removing means comprising a brush having bristles with triboelectric properties such that both said first and second toners charge to the same polarity when interacting therewith.

* * * * *